United States Patent [19]

Segreto

[11] 4,072,369

[45] Feb. 7, 1978

[54] DRILL PIPE STABBING PROTECTOR

[76] Inventor: Salvador J. Segreto, 6300 Gillen St., Metairie, La. 70003

[21] Appl. No.: 738,667

[22] Filed: Nov. 4, 1976

[51] Int. Cl.[2] ..... F16C 1/26; F16C 29/00

[52] U.S. Cl. ..... 308/4 A; 294/16

[58] Field of Search ..... 308/3.9, 238, 4 A, 4 R, 308/3 R; 214/1 P; 294/31.2, 16, 113; 64/23.6; 248/55, 59, 76; 81/53 R, 57, 177 R; 285/38, 39, 27-29, 18

[56] References Cited

U.S. PATENT DOCUMENTS

| | | | |
|---|---|---|---|
| 735,799 | 8/1903 | McGill | 294/16 |
| 2,979,926 | 4/1961 | Snyder et al. | 308/3.9 X |

*Primary Examiner*—Trygve M. Blix
*Assistant Examiner*—Douglas C. Butler
*Attorney, Agent, or Firm*—Llewellyn A. Proctor

[57] ABSTRACT

A stabbing protector device for use in oil well drilling operations which requires the continuous addition of pipe, one joint or stand to another, in the formation of drill pipe strings. The device is constituted generally of a segmented, rigid, tubular, metal body, the two tubular sections of which are hinged together so that the axial opening therethrough can be aligned with, and the jaw-like tubular sections can be closed upon, the upper segment of a threaded pipe to which another is to be threadably engaged, and locked. The novel device is provided with an upwardly faced, replaceable split-ring type protective head member constituted of a resilient material, suitably a rigid or semi-rigid plastic, natural or synthetic rubber, e.g., polyurethane. Segments of the split-ring are located on the upper face of each of the two tubular metal sections. Preferably, a similar split-ring is also provided as a foot member on the lower face of the device.

9 Claims, 4 Drawing Figures

Inventor

By

DRILL PIPE STABBING PROTECTOR

In the oil production industry, before routine operations can begin in the drilling of a well, the new well must be "spudded in," i.e., the hole must be started. Usually, a short length of tubing or casing, called conductor pipe, is set in the well. The conductor pipe may be cemented in by hand, driven into place by a pile driver, or cemented in a hole drilled in conventional manner using a kelly and rotary. The surface casing provides a means of attachment of blowout preventors and related equipment.

The formation of a well bore, after the well is spudded in, requires repeatedly cutting into the earth with a bit which is attached via a drill collar to a drill pipe, or drill pipe string, which is rotated by a swivel and kelly. Drilling requires progressively cutting depth increments of one joint of pipe, and making connections by adding to the drill string a single joint of drill pipe (usually about thirty feet). The joints are usually taken from a mousehole after having been removed from a rack and placed there for pickup by the swivel and kelly. Drilling is continued in this fashion until it is time for a bit change, as when the bit becomes dull.

Changing the bit is accomplished by making a "trip," this comprising coming out of the hole, changing the bit, reassembling the drill pipe string, and going back into the hole. When making a trip, drill pipe is often handled in stands, usually two or three joints each, dependent on the size of the drilling rig. Pipe removed from the well bore is stood on the floor of the drilling rig, as stands, until such time that the drill pipe string is reassembled for pickup by the swivel and kelly. Pipe connections in all such operations are made by adding a joint of pipe, or stands of pipe, as the well bore is drilled.

In connecting together joints, or stands, to form a drill string, or in running the several kinds of casing, it is necessary to "stab" or guide the externally threaded end of a pipe into an internally threaded coupling, through which the ends of pipe are mated in making up a connection. The swivel and kelly, e.g., is swung over the mousehole, a joint of pipe is stabbed, the joint of pipe is picked up from the mousehole, transported to the well bore, and added to the top joint of drill pipe which is held within a rotary. The drilling is continued when the bit is again in position at the bottom of the hole.

In stabbing pipe to make up a drill pipe string, or in running casing, stab damage, particularly thread damage, is an acute problem. Misalignment of the joints or stands of pipe to produce cross-threading, or the acceptance of a non-round pipe or pipe of distorted cross-section, is an even more serious problem encountered in stabbing. This not only damages threads, but also the walls of the pipe. To avoid such mishaps, and to permit drilling crews to stab at normal rates of speed, which is essential for economies of production, a stabbing protector, principally constructed of rubber, has been developed, and has been in commercial use since 1959. The rubber stabbing protector is comprised of three principal parts: (1) a tubular rubber body provided with a longitudinal split along its side by virtue of which the rubber tube can be opened and fitted upon the top portion of a pipe to which a second pipe is to be adjoined, (2) a pair of handles 180° separated one from the other extended outwardly in perpendicular orientation to the central axis of said tubular rubber body, and (3) a latch by virtue of which the tubular rubber body can be secured in place on the pipe to which the second pipe is to be adjoined. The stabbing protector is easily unlatched and removed from the pipe when the latch is released after completion of the stabbing operation. An essentially all-aluminum stabbing protector has also been introduced for the handling of large pipes. Whereas such protectors have served their purpose, further improvements are nonetheless desirable. Moreover, the stabbing protectors themselves are subject to stabbing damage and all too frequently must be replaced. This, too, is not without its economic consequence.

In view of these and other problems it is, accordingly, the primary objective of the present invention to provide a new and improved stabbing protector.

A particular object is to provide an improved stabbing device, or apparatus, which is not only useful for protecting threads, and the ends of pipe or tubing, against stabbing damage, but also of a design which in itself is longer-wearing, and capable of use over longer periods of time during stabbings conducted at normal rates of speed.

A further object is to provide a stabbing protector of sturdy, durable construction, of parts which can be easily replaced, and of character which can be structured in a variety of sizes, at relatively low cost.

These and other objects are achieved in accordance with the present invention, constituting a device or apparatus useful for protecting pipe threads, and pipe ends, during stabbing operations. The apparatus comprises the combination of (a) a tubular metal member in two sections which, when alternately disposed parallel mating surfaces are fitted together forms a body of generally cylindrical shape having an aperture axially therethrough, (b) hinge means located at one of the alternately disposed mating surfaces which connect and hold the two sections of the tubular member in permanent pivotal relationship, one section of the body relative to the other, (c) locking means located at the other of the alternately disposed mating surfaces by virtue of which the two sections constituting the body of the tubular member can be brought together and locked, (d) a handle located on each of the two sections of the tubular member constituting the body, and (e) a replaceable split-ring of a resilient material, or ring formed in two sections, one each of which is affixed upon an upper face of each of the two tubular metal sections of the body as a protective head member and, optionally but preferably, (f) a replaceable split-ring of a resilient material, of composition similar or dissimilar to that used in (e), is also located on the lower face of each of the two metal sections constituting the body as a protective foot member.

These and other features and advantages will be better understood by reference to the following detailed description and to the accompanying drawings to which reference is made in the description. In the drawings, similar letters are used to represent similar parts or components in the different figures.

Referring to the drawings.

Figure 1:
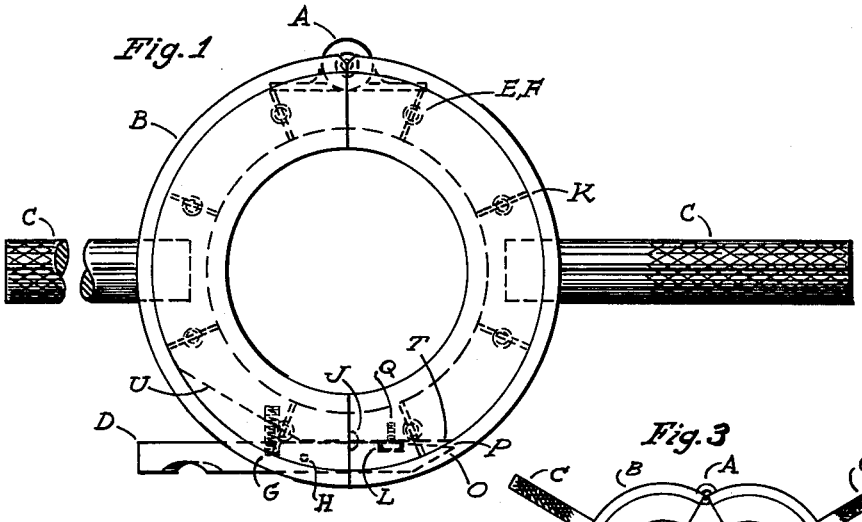
FIG. 1 depicts a top view of a preferred type of protective stabbing device, the device being shown in closed, locked position.
Figure 3:
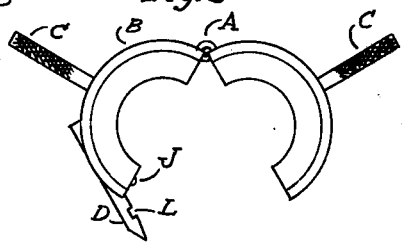
FIG. 3 is a top view of the protective stabbing device shown in open position.
Figure 2:
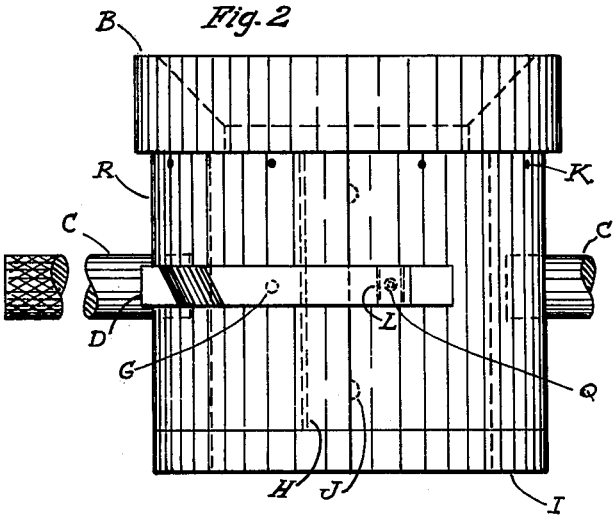
FIG. 2 depicts a side elevation view of the protective stabbing device illustrated by reference to the preceding figure.
Figure 4:
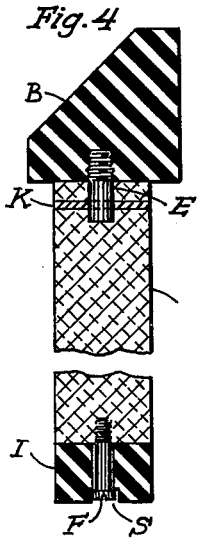
FIG. 4 is a sectional elevation view taken through a wall of the protective stabbing device, this view showing in particular detail the split-ring located at the upper face of the device and the optional, and preferred, split-ring located at the lower face of the device.

Referring to the figures, but particularly to FIGS. 1-3, a preferred type of protective stabbing device for the practice of this invention includes generally a body comprised of a rigid tubular metal member, suitably of aluminum, the wall of which is longitudinally split in alternatively disposed locations to provide two sections R,R[1] which, when the parallel mating surfaces of the two sections are brought together, form a rigid body of cylindrical shape having a central aperture which can accept pipe joints of proper dimension (and reject pipe joints of distorted shape). The two sections R,R[1] of the body are hinged together via a hinge A, or hinges, located upon one of two pairs of alternately disposed mating surfaces so that the sections R,R[1] can be swung apart and opened as shown by reference to FIG. 3, or pressed together and closed as shown by reference to FIGS. 1 and 2. A lock D is located upon the other of the two pairs of alternately disposed mating surfaces so that the sections R,R[1] can be secured together when the device is in locked position as depicted in FIGS. 1 and 2. A pair of alternately disposed handles C are provided for ease in handling the device, and for use in locking and unlocking the device. The upper face of the device is protected by a replaceable split-ring B, a replaceable head, of resilient material, suitably a plastic or plastic-like material such as a synthetic or natural rubber, e.g., polyurethane; and, optionally and preferably, the lower face of the device is similarly protected by a split-ring I constituting a replaceable foot.

The lock D is constituted of a latch bar fitted within a slot T of, and pivotally connected to, the section R via a pin H. The flat end side of latch bar is biased, via a coil spring G seated inside a well, to maintain a closed, locked position when sections R,R[1] are brought together. The notch L of said latch bar is thus biased to encompass a projection located on section K formed by a bolt Q secured therein. When the sections R,R[1] are brought together, the point P of the latch bar is raised out of the slot T and up over the projected portion of bolt Q, and then dropped back into place to hold sections R,R[1] securely together. The device can be opened only by release of the latch bar from the projection Q by pivotal rotation of said latch bar, and by manipulation of handles C to open the device. Sloped section O of latch D maintains the profile of the outside diameter of the device.

The two segments of the split-ring B are firmly secured to the upper face of sections R,R[1], respectively, by a plurality of screws E which are projected upwardly into the bottom portion of the ring segments. The screws E are held in place by the pins K. The split-ring segments I are also secured to the lower faces of the tubular body segments R,R[1] via upwardly projected screws F, fitted within openings S. A feature of split-ring B is that the member completely covers the upper face of, and is sloped inwardly toward the center, or axis; of the tubular members formed by segments R,R[1] to form in effect a funnel shaped opening. Suitably, the angle of inclination from horizontal ranges from about 30° to about 75°, preferably from about 40° to about 50°.

In operation, the jaw-like members comprising section R,R[1], initially open as depicted by reference to FIG. 3, are closed, via manipulation of externally knurled, alternately disposed handles C, upon the upper end of a joint of pipe held within a rotary. As this occurs, the two sections R,R[1] of the tubular body grip and lock upon the pipe via action of lock D. The upper faced funnel shaped replaceable split-ring B, of resilient material, provides a guide for the joint of pipe being added to slide on during pipe stabbing operations.

It is apparent that various modifications and changes, such as in the absolute and relative dimensions of the parts, materials of construction and the like, can be made without departing the spirit and scope of the invention as will be apparent to those skilled in the art.

The tubular segments of the device are preferably constructed of aluminum, but can be constructed of ferrous metals such as iron, iron alloys, steel, stainless steel and the like; or such metals as magnesium, brass, copper, bronze, alloys of these and other metals and the like.

The split-rings are generally constituted of two segments, but can be provided with a greater number of segmented portions. The rings can be constructed of a rigid or semi-rigid plastic or plastic-like material, natural or synthetic rubber. A preferred material is polyurethane. The rings can also be constructed of coated, or laminated materials.

Having described the invention, what is claimed is:

1. A stabbing protector device embodying apparatus for use in oil well drilling operations which requires the continuous addition of pipe to another in the formation of drill pipe strings, which comprises the combination of:

a tubular metal member constituted of two sections which, when alternately disposed parallel mating surfaces are fitted together, form a body of generally cylindrical shape having an aperture axially therethrough, hinge means located at one of the alternately disposed mating surfaces which connect and hold the two sections of the tubular member in permanent pivotal relationship, one section relative to the other section of the body.

locking means located at the other of the alternately disposed mating surfaces by virtue of which the two sections constituting the body of the tubular body can be brought together and locked, a handle located on each of the two sections of the tubular member constituting the body, a replaceable split-ring of a resilient materials, segments of which are located on the upper face of each of the two tubular metal sections of the body to provide a protective head member.

2. The apparatus of claim 1 wherein the device additionally includes a replaceable split-ring of resilient material, segments of which are located on the lower face of each of the two tubular metal sections of the body to provide a protective foot member.

3. The apparatus of claim 1 wherein the split-ring constituting the protective head member completely covers the upper face of the two tubular metal sections constituting the body of the apparatus, and is sloped inwardly toward the axis of the tubular members to form a funnel-shaped opening.

4. The apparatus of claim 3 wherein the angle of inclination of the shape from horizontal ranges from about 30° to about 75°.

5. The apparatus of claim 3 wherein the angle of inclination of the slope from horizontal ranges from about 40° to about 50°.

6. The apparatus of claim 3 wherein the split-ring constituting the protective head member is constituted of a rigid or semi-rigid plastic, and the tubular sections constituting the body on which the split-ring is mounted is constituted of aluminum.

7. The apparatus of claim 6 wherein the split-ring is constituted of polyurethane.

8. The apparatus of claim 6 wherein the device additionally includes a replaceable split-ring constituted of a rigid or semi-rigid plastic, segments of which are located on the lower face of each of the two tubular metal sections of the body to provide a protective foot member.

9. The apparatus of claim 8 wherein the split-ring is constituted of polyurethane.

* * * * *